US005388601A

United States Patent [19]

Mansur

[11] Patent Number: 5,388,601

[45] Date of Patent: Feb. 14, 1995

[54] SPRAY GUN WASHING APPARATUS

[76] Inventor: Pierre G. Mansur, 8425 SW. 129 Terrace, Miami, Fla. 33156

[21] Appl. No.: 212,813

[22] Filed: Mar. 15, 1994

[51] Int. Cl.[6] ..... B08B 3/10

[52] U.S. Cl. ..... 134/56 R; 134/105; 134/107; 134/169 R; 134/169 C; 134/170; 134/109

[58] Field of Search ..... 134/105, 107, 108, 109, 134/170, 169 R, 166 C, 169 C, 200, 56 R; 68/18 C

[56] References Cited

U.S. PATENT DOCUMENTS

| | | | |
|---|---|---|---|
| 1,697,767 | 1/1929 | Hirst | 68/18 C |
| 2,070,204 | 2/1937 | Hetzer | 68/18 C |
| 2,243,093 | 5/1941 | Flahive | 68/18 C |
| 2,682,273 | 6/1954 | Roach | 134/170 |
| 3,177,126 | 4/1965 | Charreau | 68/18 C |
| 3,771,539 | 11/1973 | De Santis | 134/170 |
| 4,101,340 | 7/1978 | Rand | 134/109 |
| 4,770,197 | 9/1988 | Prisco, Jr. et al. | 134/109 |
| 4,785,836 | 11/1988 | Yamamoto | 134/200 |
| 5,193,561 | 3/1993 | Robb et al. | 134/166 C |
| 5,318,056 | 6/1994 | Kusz et al. | 134/95.3 |

*Primary Examiner*—Frankie L. Stinson
*Attorney, Agent, or Firm*—Robert M. Downey

[57] ABSTRACT

An apparatus for washing paint spray guns and associated equipment with a liquid solvent for the purpose of cleaning and removing paint therefrom after use in painting operations. The apparatus includes a cleaning chamber having solvent dispersing nozzles therein, the nozzles being structured and disposed for spraying the liquid solvent onto exterior and interior surfaces of the spray gun, paint canister and other equipment supported within the cleaning chamber for cleaning thereof. The used solvent is collected in a holding chamber having a float switch therein which activates a solenoid controlled valve upon the used solvent reaching a predetermined level, releasing the contaminated solvent into a distillation chamber for boiling. Purified vapors pass through a condenser where they are cooled to a liquid state, yielding pure solvent which is directed into a clean solvent tank. A pump circulates the purified solvent from the clean solvent holding tank to the dispersing nozzles in the cleaning chamber.

7 Claims, 4 Drawing Sheets

FIG. 2A
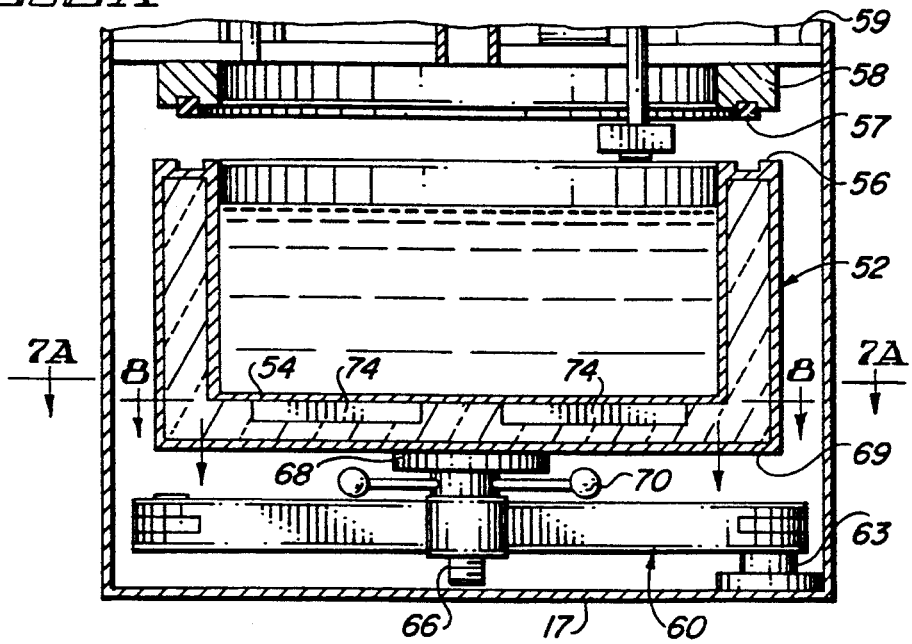
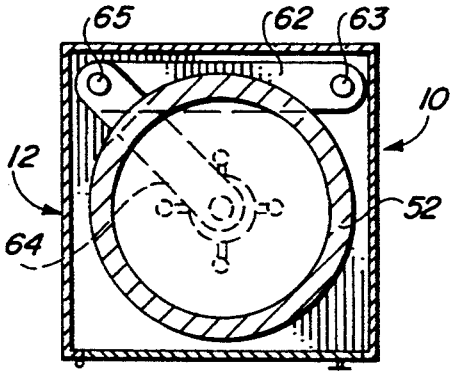
FIG. 7A
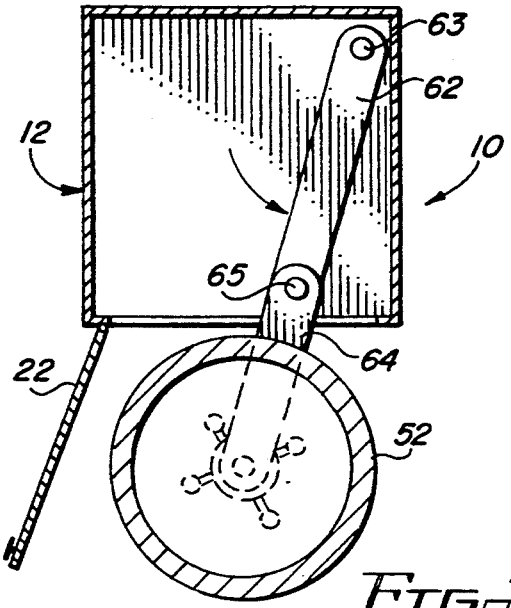
FIG. 7C
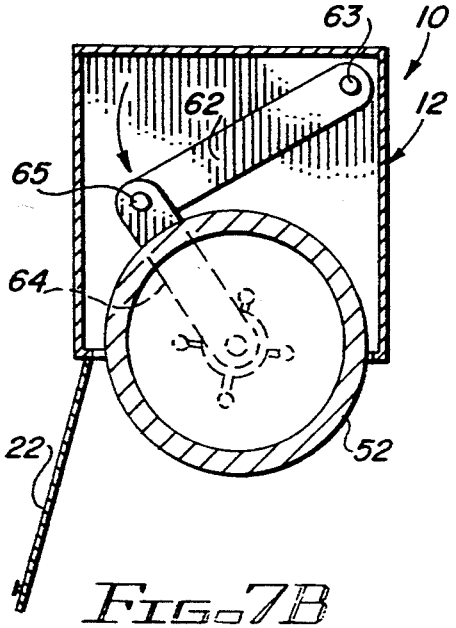
FIG. 7B
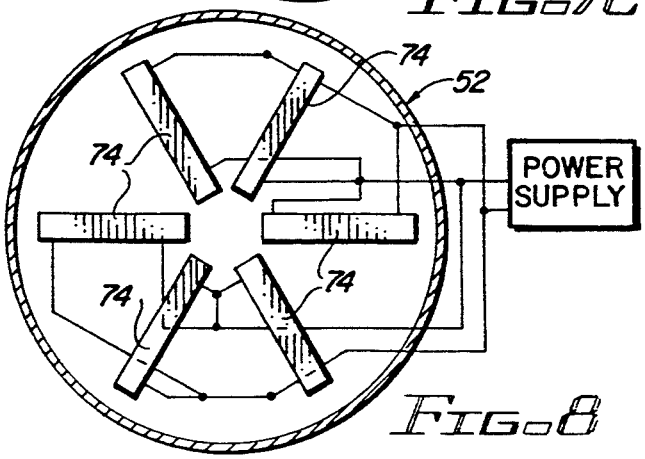
FIG. 8

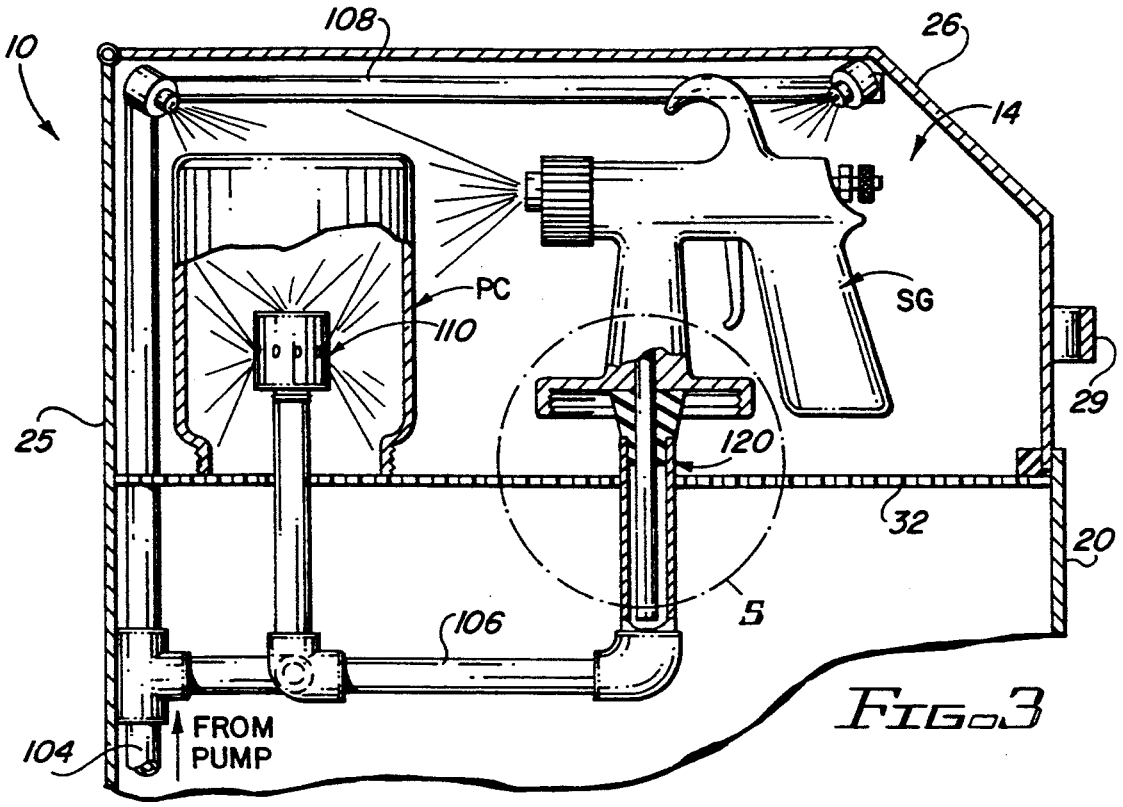
FIG. 3
FIG. 4
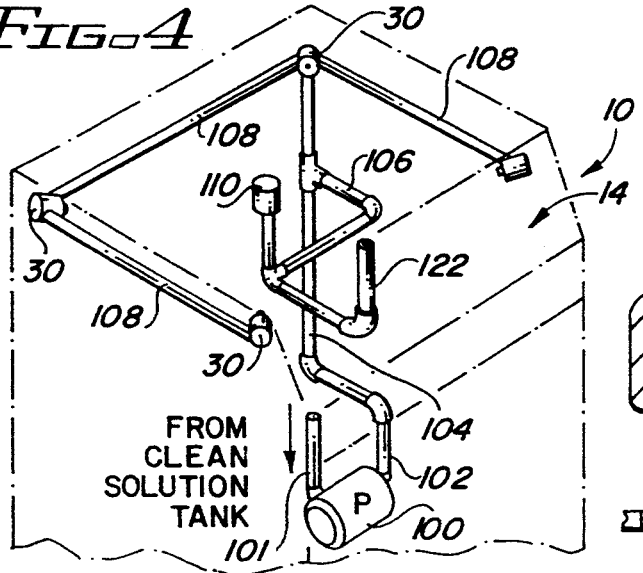
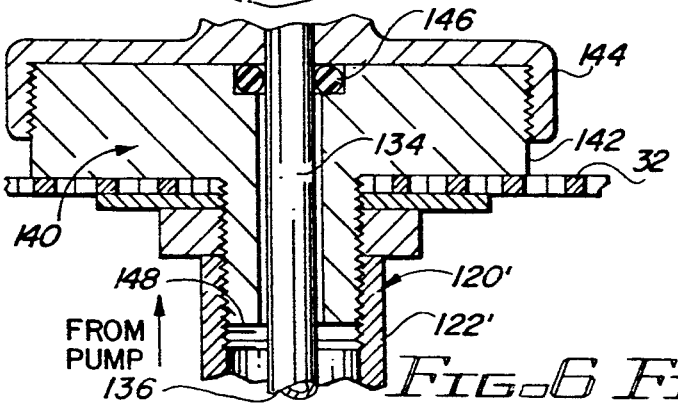
FIG. 6
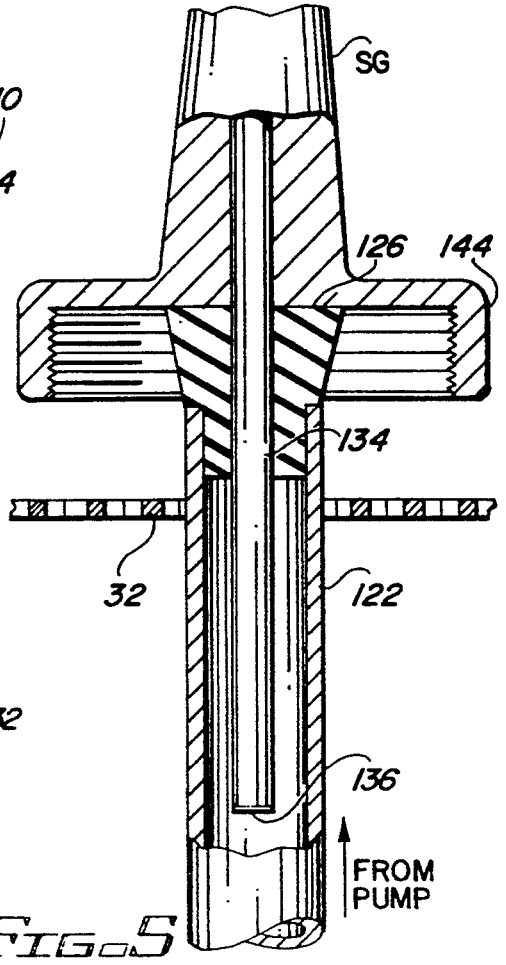
FIG. 5

SPRAY GUN WASHING APPARATUS

BACKGROUND OF THE INVENTION

1. Field of the Invention

The present invention is directed to an apparatus for washing spray guns with a liquid solvent, and more particularly to an apparatus for washing paint spray guns and associated component parts with a liquid solvent and including means for recycling the solvent to provide purified solvent for subsequent cleaning operations.

2. Description of the Related Art

Paint spray gun assemblies have long been used in various painting operations, particularly in the automobile and marine industries. Typically, a paint spray gun assembly includes a hand-held spray gun and a can or cud which attaches to the gun for holding paint to be supplied to the gun for spraying therefrom. Generally, paint spray gun assemblies include two types of systems. These include siphon spray guns for use with small scale jobs in which a small amount of paint is required, and pressure spray guns which are usually used for large scale jobs requiring a significant amount of paint. The use of such equipment is primarily to enable rapid painting of objects. After use of the spray gun assembly during a particular job, the entire assembly, including the gun, cup and associated component parts must be thoroughly cleaned of the paint which accumulates both on the interior and exterior surfaces of the equipment. Cleaning of the equipment is required not only to prevent mixing of colors, which may result in an undesirable color blend, but also to prevent buildup, blockage and jamming of the equipment. Obviously, in a commercial environment, such as a paint workshop, the need to clean the equipment on a regular basis entails a great deal of time and expense. Usually, a paint workshop, such as an automotive paint shop, will use numerous spray gun assemblies throughout a daily painting operation. In this instance, it will usually be required to clean a number of spray gun assemblies on a daily basis, and possibly several times a day if the assemblies are used with different paint colors.

In an attempt to minimize the time and expense associated with cleaning a large number of spray gun assemblies on a daily basis, there has been developed various spray gun washers which are designed to circulate a cleaning fluid through a flow-line system for ejection of the fluid under pressure within a closed cabinet. An example of such an apparatus is disclosed in the U.S. Patents to Yamamoto, U.S. Pat. No. 4,785,836 and Robb et al., U.S. Pat. No. 4,793,369. The spray washer apparatus disclosed in these patents generally comprise a cabinet or housing divided into a work chamber and a fluid storage reservoir containing paint solvent and water. The solvent and water mixture is pumped from the storage reservoir to spray nozzles located in the work chamber. The paint spray gun and can are supported in the cleaning chamber such that the paint passage interior of the gun is in direct fluid flow communication with the fluid outlets. Thus, during cleaning, the solvent in Dumped from the storage reservoir out through the nozzles to clean the exterior of the spray gun and can and also through the gun and within the inside of the can to clean the inner surfaces thereof. The contaminated solution then returns to the storage reservoir for subsequent use. After a period of time, the contaminated solution is drained from a bottom of the storage reservoir by opening a valve, and fresh cleaning solvent are replaced within the reservoir. While these spray washers have been found to be effective for use in washing spray guns and associated parts, they do not provide for recycling and purifying of the cleaning solvent. Therefore, the contaminated solvent must be disposed of on a regular basis while complying with E.P.A. disposal guidelines. This disposal process can prove to be inefficient, costly and therefore, most paint workshops using this washing equipment tend to reuse the cleaning solution for an extended period of time, resulting in the use of contaminated cleaning solvent-/solution being used during cleaning operations.

There has been developed a cleaning apparatus for cleaning painted parts which provides for the recycling of the cleaning solvent. Such an apparatus is disclosed in the U.S. Patent to Ihringer, U.S. Pat. No. 4,407,316 directed to a cleaning installation comprising a treatment chamber in which the painted parts are cleaned and exposed to jets of a mixture of hot water and cleaning solvent. The installation, as disclosed in Ihringer includes a plurality of individual separating chambers for separating light paint solvents, cleaning solvent of paint, water cleaning solvent and gas cleaning solvent. This type of cleaning installation is somewhat complex, use a series of separating chambers, requires a significant amount of space and is generally cost prohibitive for most paint workshop environments.

Accordingly, there is a definite need in the spray gun art for a washing apparatus specifically designed for washing both the exterior and interior surfaces of paint spray guns, paint cans and associated component parts with a solvent, such as paint thinner, wherein the apparatus provides means for recycling the solvent to provide pure, continuous "on demand" fresh solvent. Such an apparatus eliminates the disposal and replacement problems normally associated with paint spray gun washers while providing a practical means of complying with E.P.A. disposal guidelines.

Summary of the Invention

The present invention is directed to an apparatus for washing spray gun apparatus with a cleaning solvent such as paint thinner.

More particularly, the present invention is directed to an apparatus for washing paint spray gun equipment, including spray guns, paint cans and other associated component parts.

The spray gun washing apparatus of the present invention includes a cabinet having an upper portion defining a cleaning chamber having a plurality of spray nozzles therein, and means to support at least one paint spray gun, a paint can and other component parts, such that the solvent is sprayed onto both exterior and interior surfaces of the spray gun and equipment for removing paint therefrom. A lower portion of the cabinet includes a solvent holding chamber disposed in fluid communication with the cleaning chamber such that, after use for washing, the contaminated cleaning solvent is collected in the holding chamber. Upon reaching a predetermined level in the holding chamber, a float switch activates a solenoid controlled valve which releases the contaminated solvent to a distillation chamber. The contaminated solvent is heated to a predetermined temperature in the distillation chamber, producing purified solvent vapors which pass through a condenser where they are cooled to a liquid state, yielding pure solvent. The pure solvent is directed into a clean solvent holding tank for subsequent circulation to spray nozzles disposed throughout the cleaning chamber. Accordingly, the present invention provides for continuous recycling of contaminated solvent so that pure, non-contaminated solvent is provided continuously "on demand" throughout washing operations. In this manner, the cost and inefficiency associated with disposal of contaminated paint thinner or solvent, as well as the need to comply with E.P.A. disposal guidelines, is eliminated.

Accordingly, with the foregoing in mind, it is a primary object of the present invention to provide a spray gun washing apparatus for use in washing spray gun equipment such as paint spray guns, paint cans and other component parts, which includes means for recovering and recycling of the solvent or paint thinner so as to provide the user with "on demand" pure solvent-/paint thinner continuously throughout washing operations.

It is another object of the present invention to provide a spray gun washing apparatus as described above which eliminates the need for constant replacement and disposal of contaminated solvent/paint thinner, while providing a practical and economical means of complying with E.P.A. contaminate disposal guidelines.

It is a further object of the present invention to provide a spray gun washing apparatus adapted to recycle solvent/paint thinner so as to provide fresh, pure solvent/paint thinner on a continuous basis. It is still a further object of the present invention to provide a spray gun washing apparatus, as described above, which operates on common 120 volts and which further requires no special water or air supply requirements.

It is yet another object of the present invention to provide a spray gun washing apparatus, as described above, which is relatively compact and inexpensive, making the apparatus available for use in virtually all commercial environments where spray gun equipment is used.

It is still another object of the present invention to provide a spray gun washing apparatus as described above, which complies with all government imposed safety and health regulations.

These and other objects and advantages of the present invention will be more readily apparent in the description which follows.

BRIEF DESCRIPTION OF THE DRAWINGS

For a fuller understanding of the nature of the present invention, reference should be had to the following detailed description taken in connection with the accompanying drawings in which:

FIG. 2(A) is an isolated front elevation, in partial section, illustrating removal of a distillation chamber from a mating lid means, to facilitate outward movement of the distillation chamber from within a lower cabinet interior for cleaning thereof.

FIG. 3 is an isolated view, in partial section, of a cleaning chamber of the present invention illustrating a paint spray gun and paint canister being washed within the cleaning chamber by solvent (paint thinner) being sprayed from various nozzles to clean exterior and interior surfaces of the equipment.

FIG. 4 is a perspective view of the plumbing system defining a circulation system for circulating clean solvent/paint thinner from a clean holding tank to the various nozzles throughout the cleaning chamber.

FIG. 5 is an isolated view, in partial section, illustrating a spray gun mount for supporting a spray gun and directing solvent/paint thinner internally through a spray gun for cleaning thereof.

FIG. 6 is a sectional view of an alternative spray gun mount of the present invention.

FIGS. 7(*a*), 7(*b*) and 7(*c*) are top plan views taken along line 7A—7A of FIG. 2A, of a distillation chamber illustrating, in sequence, movement of a distillation chamber from within a lower cabinet interior of the apparatus for cleaning thereof.

FIG. 8 is a plan view along line 8—8 of FIG. 2A of an inner bottom of the distillation chamber showing a power supply connection to heating elements therein.

Like reference numerals refer to like parts throughout the several views of the drawings.

DETAILED DESCRIPTION OF THE PREFERRED EMBODIMENT

Figure 1:
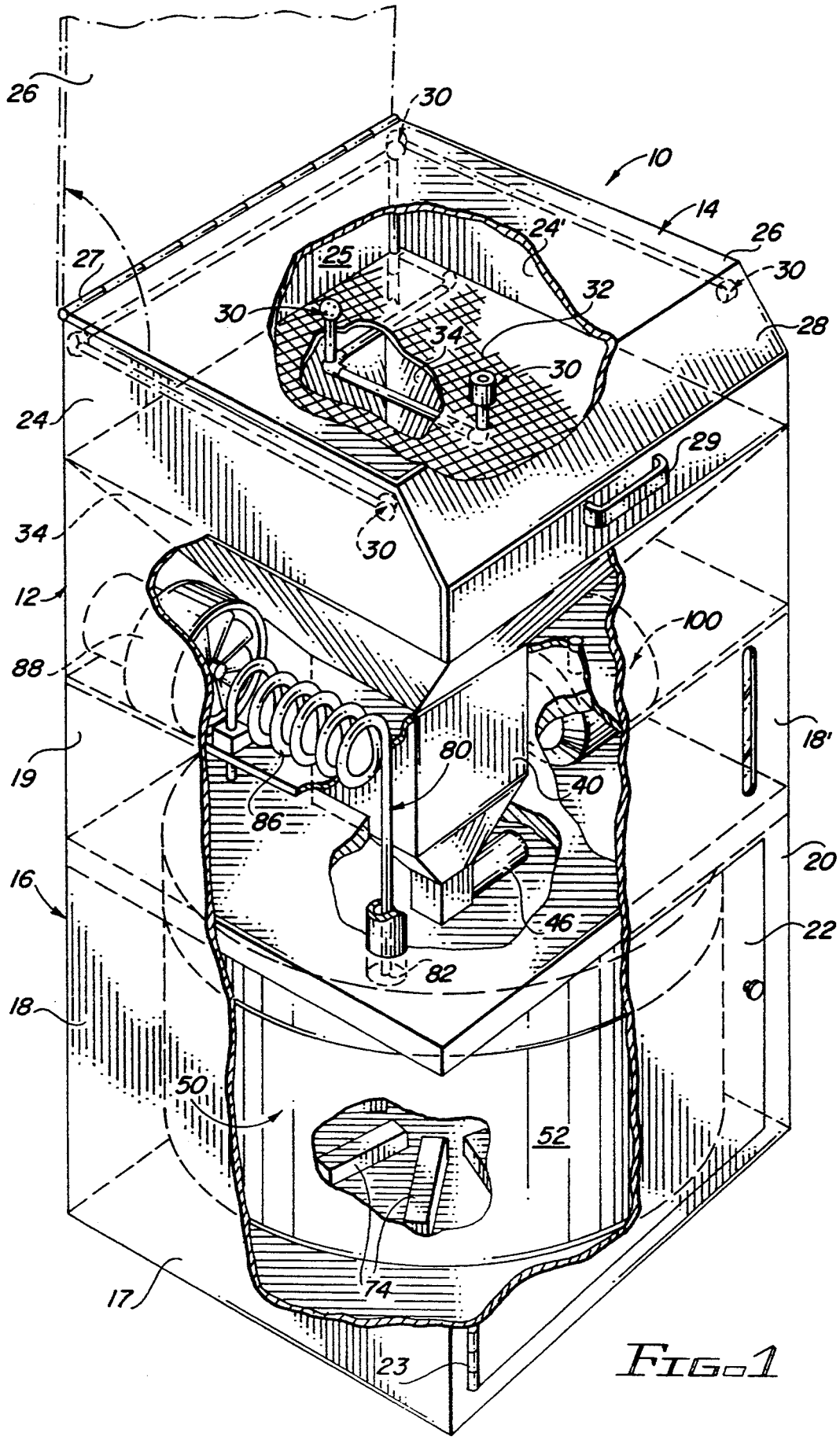
FIG. 1 is a front perspective view, in partial cutaway, illustrating the spray gun washing apparatus of the present invention.
Figure 2:
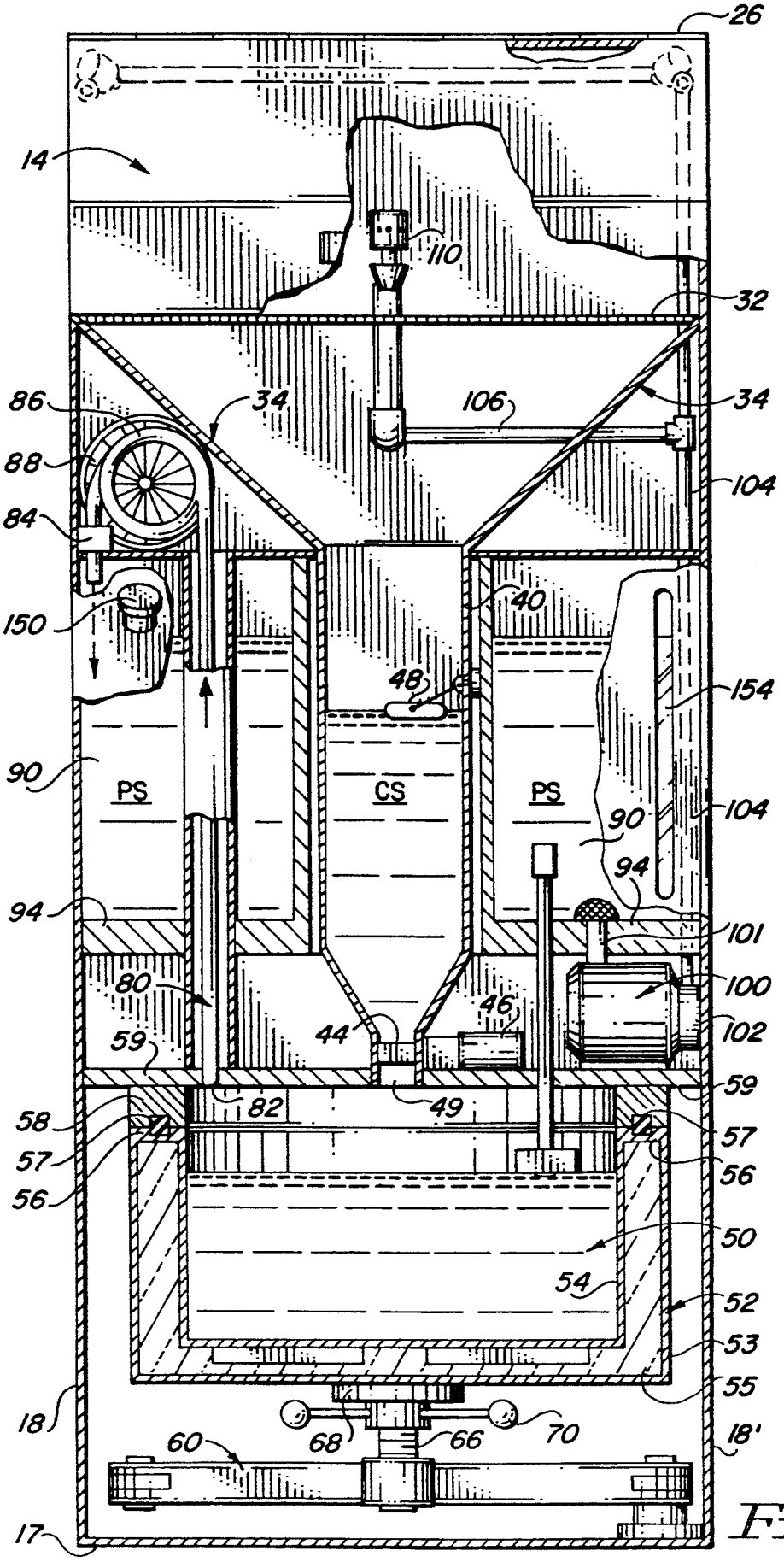
FIG. 2 is a front elevation, in partial section, of the spray gun washing apparatus of FIG. 1.

Referring to the several views of the drawings, and initially FIGS. 1 and 2, there is generally illustrated the spray gun washing apparatus 10 of the present invention. The apparatus 10 includes a cabinet 12 including an upper portion 14 defining a cleaning chamber and a lower portion 16 including a base 17, side walls 18, 18', rear wall 19 and a front wall 20. The front wall 20 is provided with at least a single door 22 which is hingedly attached to the front wall, such as at 23, to facilitate opening thereof to gain access to an interior of the cabinet 12.

The upper portion of the cabinet 12 defining the cleaning chamber 14 includes opposite side wall portions 24, 24' a rear wall portion 25 and a cover 26 hingedly attached to a top edge of the rear wall 25, as at 27, and movable between an open position and a closed position in covering relation to an interior of the cleaning chamber to prevent solvent from splashing and vapors from escaping from within the cleaning chamber during washing operations. The cover 26 may be formed so as to include a front 28 including a handle 29 to better facilitate raising and lowering of the cover 26.

Within the cleaning chamber 14 there are a plurality of solvent disbursing spray nozzles 30 (described in more detail hereinafter) for directing a sprayed array of solvent onto exterior and throughout interior surfaces of the spray gun equipment placed therein. A rigid screen 32 may also be provided within the cleaning chamber to prevent articles from falling down into a contaminated solvent holding chamber. Below the screen 32 a floor 34 of the cleaning chamber slopes downwardly and inwardly on all sides towards the centrally disposed contaminated solvent holding chamber 40 in fluid communication therewith, such that contaminated solvent/paint thinner which drips down, after being disbursed within the cleaning chamber, is collected and contained within the contaminated solvent holding tank 40. A valve 44 controlled by a solenoid 46 contains the contaminated solvent CS within the contaminated solvent holding chamber 40 until the solvent level reaches a predetermined height at which point a float switch 48 activates solenoid 46 to open the valve 44, thus releasing the contaminated solvent CS through a bottom port 49 of the solvent holding chamber 40 into a distillation chamber 50. The floor 34, surfaces of the holding chamber 40 and the distillation chamber 50 are all thoroughly coated with a non-stick coating to prevent paint and contaminants from drying and adhering thereto.

The distillation chamber 50 comprises a double walled distillation pot 52 including an outer wall 53 and an inner wall 54, having the non-stick coating on an inner surface thereof, and insulating material 55 disposed between the outer 53 and inner wall 54. A rim 56 of the distillation pot 52 surrounds an open top thereof and includes means for accommodating a seal 57 which may be fitted to the rim 56 or, alternatively, to a mating upper rim 58 attached to and extending downwardly from a stationery plate 59 defining, cooperatively with the upper rim 58, a lid for covering the open top of the distillation pot 52.

The distillation pot 52 is supported on a hinged arm assembly 60 having a first arm member 62 and a second arm member 64 hingedly attached to one end of the first arm member 62 at hinge point 65, as best seen in FIGS. 7(A)–7(C). An end of the second arm member 64, opposite of the hinge point 65, includes means for threaded receipt of support shaft 66 therethrough. The distillation pot 52 is supported on a flanged plate 68 which engages a bottom 69 of the distillation pot 52, such that rotation of wheel arms 70 serves to threadably advance the shaft 66 in either an upward or downward direction, thereby raising or lowering the plate 68 and the distillation pot 52. In this manner, the distillation pot 52 is either raised causing the rim 56 to mate in sealed engagement with the upper rim 58 or, alternatively, by rotating the wheel arms 70 in an opposite direction the distillation pot 52 is lowered, separating the rim 56 of the distillation pot from the upper rim 58, as seen in FIG. 2(A). Once separated from the upper rim 58, the distillation pot 52 can be conveniently removed from within the cabinet interior as illustrated, sequentially, in FIGS. 7(A) through 7(C).

The first arm member 62 is hinged at a fixed hinged point 63 to the base 17 of the cabinet. With the front door 22 opened, the distillation pot 52 can be easily pulled outwardly causing the hinge point 65 to move from a rear of the cabinet interior outwardly towards the door opening resulting in the second arm member 64 becoming substantially aligned with the first arm member 62, with the distillation pot 52 supported exteriorly of the cabinet interior. Once removed from within the cabinet 12, access through the open top of the distillation pot 52 is easily permitted, thus facilitating cleaning of accumulated contaminates such as paint, which remains in the distillation pot during boiling and vaporization of the solvent/paint thinner.

A plurality of heating elements 74 are provided within the bottom of the distillation pot 52 below the inner wall 54 in heat transferring relation therewith, as seen in FIG. 2A. The heating elements 74 are activated during washing operations in order to boil the solvent-/paint thinner to produce purified solvent vapors.

Referring again to FIGS. 1 and 2, a condenser tube 80 includes a first end 82 attached through the plate 59 defining the lid of the distillation chamber 50 and an opposite end 84 disposed in fluid communication with a clean solvent tank 90. A mid-section 86 of the condenser tube 80 is coiled and passes through a cooling zone and defines a condenser. The cooling zone is cooled by air flow created by blower 88. Air is drawn through the cooling zone and discharged by the blower through the rear wall 19 of the cabinet 12. Thus, as purified solvent vapors rise up through the condenser tube 80 and into the coiled mid-section 86 in the cooling zone, the vapors are condensed to produce purified, non-contaminated solvent/paint thinner which drips down into the clean solvent tank 90 from the end 84 of the condenser tube 80.

The intake 101 of a pump 100 connects through the bottom 94 of the clean solvent holding tank 90 for circulating the clean solvent from the holding tank 90 out through a discharge 102 of the pump 100 and up through conduit 104 to the spray nozzles 30 within the cleaning chamber 14. As seen in FIG. 4, the conduit 104 leading form the discharge of the pump 100 branches off into a flow-line system of various lines leading to the dispersing spray nozzles 30 disposed at various locations throughout the cleaning chamber 14. One line 106 leads towards a central area of the cleaning chamber 14 and to a multidirectional spray head 110 and a spray gun mount 120. The multidirectional spray head 110 is specifically adapted for receipt within the interior of a paint can or jar PC, as seen in FIG. 3, such that solvent is sprayed throughout the interior of the paint can PC to clean the interior surfaces thereof. The spray gun mount 120 is specifically adapted to facilitate fluid connection of an internal passage of a spray gun SG with the solvent supply line leading from conduit 104. As seen in FIGS. 3 and 5, a first embodiment of the gun mount 120 comprises an upwardly directed rigid conduit 122 extending upwardly through the screen 32 and terminating at an open end. A plug 126 is fitted therein and includes a central axial bore for passage of a hose 134 of the spray gun therethrough so that a distal end 136 of the hose 134 is disposed within the upwardly directed conduit 122. Accordingly, upon circulation of solvent-/paint thinner from the pump 100 through the conduit 104 and 106 and upwardly through the conduit 122, the solvent is directed through the end of the hose 134 and throughout the internal passage of the spray gun, exiting through the spray head of the gun, as seen in FIG. 3.

An alternative embodiment of the gun mount 120' is seen in FIG. 6, wherein the upwardly directed conduit 122' terminates below the screen 32. An adapter 140 is threadably engaged within the open top end of the upwardly directed conduit 122' and includes an enlarged flanged portion 142 having threads adapted for engagement with an inner threaded surface of a collar 144 of the spray gun. The adapter includes an axial bore extending therethrough for passage of the hose 134 of the spray gun such that the distal end 136 of the hose is disposed within the upwardly directed supply pipe. Seals 146, 148 are provided at opposite ends of the axial bore for sealed engagement about the hose 134. In this manner, as solvent/paint thinner is circulated to the upwardly directed conduit 122', the solvent is directed through the distal end of the hose 134 and throughout the internal passage of the spray gun, exiting in the same manner as illustrated in FIG. 3.

The supply conduit 104 further leads to branch conduits 108 extending about the cleaning chamber and leading to a plurality of the spray nozzles 30 specifically structured and disposed for spraying solvent on external surfaces of the spray gun equipment being washed.

A refill port 150 is provided on the cabinet exterior to facilitate refilling or adding clean solvent/paint thinner to the clean solvent holding tank 90. The front wall or side walls of the cabinet 14 may further be provided with a site level gauge 154 to enable visual determination of the level of purified solvent/paint thinner PS contained within the clean solvent holding tank 90.

Now that the invention has been described,

What is claimed is:

1. An apparatus for cleaning spray gun assemblies comprising:

a cabinet including a lower portion having a base, side walls, a back wall and a front in surrounding relation to a cabinet interior and an upper portion including a cleaning chamber having side wall portions, a front wall portion, a rear wall portion and a cover hingedly attached to said rear wall portion, said cover being movable between an open position facilitating access to said cleaning chamber and a closed position in covering relation to an interior of said cleaning chamber, solvent dispersing means including a plurality of spray nozzles positioned and arranged within said cleaning chamber and being structured and disposed for spraying the solvent onto exterior and interior surfaces of the spray gun assemblies placed within said cleaning chamber for cleaning thereof, a solvent holding chamber disposed in fluid communication with said cleaning chamber and structured and disposed for containing contaminated solvent after use during cleaning in said cleaning chamber, a distillation chamber disposed in fluid communication with said holding chamber and including an insulated surrounding side wall structure, an insulated base and an open top, means defining a lid for covering said open top of said distillation chamber in sealed, airtight relation therewith, valve means between said holding chamber and said distillation chamber and being operable between a closed position to contain the solvent in said holding chamber and an open position to release the solvent into said distillation chamber, fluid level monitor means for detecting and monitoring a level of the solvent in said holding chamber, switch means communicating with said fluid level monitor means and structured and disposed for operating said valve means to said open position upon a level of the solvent in the holding chamber reaching a predetermined level as detected by the fluid level monitor means, a clean solvent tank for containing purified, non-contaminated solvent therein for subsequent circulation to said dispersing means, a plurality of heating elements disposed in heat transferring relation with said distillation chamber for heating the solvent to a predetermined temperature so as to produce solvent vapors, a condenser including a condensing tube having a first end connected in fluid communication with said distillation chamber for recovering the solvent vapors, a mid-portion disposed in a cooling zone within said cabinet arid a second opposite end disposed in fluid communication with said clean solvent tank for directing purified, condensed liquid solvent into said clean solvent tank, a blower disposed within said cooling zone for creating an air current therethrough to cool said mid-portion of said condensing tube, and a pump for circulating the purified liquid solvent, at a predetermined pressure, from said clean solvent tank to said solvent dispersing means resulting in the solvent being dispersed from said spray nozzles into said cleaning chamber.

2. An apparatus for cleaning articles with a solvent comprising:

a cleaning chamber structured and disposed to accommodate the articles to be cleaned therein, solvent dispersing means within said cleaning chamber and structured and disposed to spray the solvent onto exterior and interior surfaces of the articles for cleaning thereof, solvent collection means for collecting the solvent after spraying the articles, a solvent holding chamber disposed in fluid communication with said collection means, said holding chamber being structured and disposed for containing contaminated solvent after use for cleaning, a distillation chamber in fluid communication with said holding chamber and including an insulated surrounding side wall structure, and an insulated base and an open top, means defining a lid for covering said open top of said distillation chamber in sealed, air tight relation therewith, valve means between said holding chamber and said distillation chamber and operable between a closed position to contain the solvent in said holding chamber, and an open position to release the solvent into said distillation cheer, a clean solvent tank for containing purified, non-contaminated solvent therein, heating means for heating the solvent in said distillation chamber to a predetermined temperature so as to produce solvent vapors, condenser means for condensing the solvent vapors produced in said distillation chamber to yield purified, non-contaminated solvent, said condenser means being interconnected in fluid communication with said clean solvent tank for directing the purified, non-contaminated solvent therein, circulation means for circulating the purified non-contaminated solvent from said clean solvent tank to said solvent dispersing means, a cabinet including a lower portion having a base and surrounding walls in surrounding relation to a cabinet interior, said cabinet further including an upper portion defined by said cleaning chamber, and means to facilitate movement of said distillation chamber from within the cabinet interior to facilitate access to an interior or said distillation chamber.

3. An apparatus as recited in claim 2 wherein said solvent dispersing means includes a plurality of spray nozzles, said spray nozzles including at least one multi-directional spray head adapted for receipt within a paint can of a spray gun assembly for cleaning interior surfaces thereof.

4. An apparatus as recited in claim 3 wherein said spray nozzles further include at least one spray gun mount having means thereon for fluid connection with an interior passage of a paint spray gun such that the solvent circulated by the circulation means is directed through the passage of the paint spray gun for cleaning thereof.

5. An apparatus as recited in claim 2 further comprising fluid level monitor means for detecting and monitoring a level of contaminated solvent in said holding chamber.

6. An apparatus as recited in claim 5 further comprising switch means interconnected to said fluid level monitor means and said valve means for operating said valve means to said open position upon the contaminated solvent reaching a predetermined level in said holding chamber as detected by said fluid level monitor means.

7. An apparatus for cleaning articles with a solvent comprising:

a cleaning chamber structured and disposed to accommodate the articles to be cleaned therein, solvent dispersing means within said cleaning chamber and structured and disposed to spray the solvent onto exterior and interior surfaces of the articles for cleaning thereof, solvent collection means for collecting the solvent after spraying the articles, a solvent holding chamber disposed in fluid communication with said collection means, said holding chamber being structured and disposed for containing contaminated solvent after use for cleaning, a distillation chamber in fluid communication with said holding chamber and including an insulated surrounding side wall structure, and insulated base and an open top, means defining a lid for covering said open top of said distillation chamber in sealed, air tight relation therewith, valve means between said holding chamber and said distillation chamber and operable between a closed position to contain the solvent in said holding chamber, and an open position to release the solvent into said distillation chamber, a clean solvent tank for containing purified, non-contaminated solvents therein, heating means for heating the solvent in said distillation chamber to a predetermined temperature so as to produce solvent vapors, a condenser including a condensing tube having a first end connected in fluid communication with said distillation chamber for recovering the solvent vapors, a mid-portion disposed in a cooling zone within said cabinet and a second opposite end disposed in fluid communication with said clean solvent tank for directing purified, condensed liquid solvent into said clean solvent tank, a blower disposed within said cooling zone for creating an air currant therethrough to cool said mid-portion of said condensing tube, and circulation means for circulating the purified, non-contaminated solvent from said clean solvent tank to said solvent dispersing means resulting in the solvent being dispersed within said cleaning chamber.

* * * * *